US010493462B2

(12) United States Patent
Colson et al.

(10) Patent No.: US 10,493,462 B2
(45) Date of Patent: Dec. 3, 2019

(54) SYSTEM, METHOD AND APPARATUS FOR UPGRADING A PULVERIZER

(71) Applicant: GENERAL ELECTRIC TECHNOLOGY GMBH, Baden (CH)

(72) Inventors: Paul M. Colson, Westfield, MA (US); Douglas W. Crafts, Longmeadow, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 607 days.

(21) Appl. No.: 15/188,342

(22) Filed: Jun. 21, 2016

(65) Prior Publication Data

US 2017/0361328 A1 Dec. 21, 2017

(51) Int. Cl.
*B02C 15/00* (2006.01)
*B02C 15/04* (2006.01)

(52) U.S. Cl.
CPC ..... *B02C 15/004* (2013.01); *B02C 15/003* (2013.01); *B02C 15/04* (2013.01)

(58) Field of Classification Search
CPC ..... B02C 15/004; B02C 15/04; B02C 15/003; B02C 15/001; B02C 2015/002; B02C 25/00; G05G 5/04; Y10T 29/49716; C10B 57/00
See application file for complete search history.

(56) References Cited

U.S. PATENT DOCUMENTS

| | | | | |
|---|---|---|---|---|
| 3,138,337 | A | 6/1964 | Bogot et al. | |
| 3,409,236 | A * | 11/1968 | Hamilton | B02C 15/005 241/232 |
| 8,087,172 | B2 | 1/2012 | Farris et al. | |
| 2010/0119187 | A1 | 5/2010 | Creelman et al. | |
| 2017/0355047 | A1 | 12/2017 | Michael et al. | |
| 2017/0356643 | A1 | 12/2017 | Dragisa et al. | |

OTHER PUBLICATIONS

International Search Report and Written Opinion issued in connection with corresponding PCT Application No. PCT/EP2017/065190 dated Oct. 5, 2017.

* cited by examiner

*Primary Examiner* — Jacob J Cigna
*Assistant Examiner* — Lee A Holly
(74) *Attorney, Agent, or Firm* — Gorgan, Tuccillo & Vanderleeden, LLP

(57) ABSTRACT

A method of upgrading a vertical spindle pulverizer includes the steps of removing a cover from a journal opening in a housing of the pulverizer to access a grinding zone of the pulverizer, removing a first journal assembly having a toroidal grinding roll from the pulverizer through the journal opening, removing a plurality of toroidal table segments from a grinding table of the pulverizer, installing a plurality of inclined bull ring segments on the grinding table, installing a second journal assembly having a conical grinding roll in the pulverizer, and replacing the cover over the journal opening. The inclined bull ring segments are configured to register with a grinding surface of the conical grinding roll.

15 Claims, 6 Drawing Sheets

SYSTEM, METHOD AND APPARATUS FOR UPGRADING A PULVERIZER

TECHNICAL FIELD

Embodiments of the invention relate to solid fuel pulverizers and, more particularly, to a system, method and apparatus for upgrading a pulverizer.

DISCUSSION OF ART

Solid fossil fuels such as coal often are ground in order to render the solid fossil fuel suitable for certain applications. Grinding the solid fossil fuel can be accomplished using a device referred to by those skilled in the art as a pulverizer. One type of pulverizer suited for grinding is referred to as a "bowl mill pulverizer". This type of pulverizer obtains its name by virtue of the fact that the pulverization that takes place therein is effected on a grinding surface that in configuration bears a resemblance to a bowl.

With reference to FIG. 1, a conventional bowl mill pulverizer 10 includes a generally cylindrical housing 12 having a grinding surface 14 at a bottom thereof which is fed with a supply of raw coal through a centrally located coal chute 16. The housing 12 includes one or more journal openings 18 within which a respective journal assembly 20 is pivotally mounted via a pivot shaft 32. A distal portion of each journal assembly 20 is connected to a torus-shaped grinding roll or roller 22 which interacts with the grinding surface 12 to grind the raw coal to a desired degree of fineness. In operation, raw coal is fed through the coal chute 16 and falls by force of gravity to the grinding surface 14. The grinding surface 14 is rotated, causing the grinding rollers 22 to rotate. The raw coal is crushed between the grinding rollers 22 and the grinding surface 14.

As the grinding rolls 22 grind the coal, air flows into an air inlet port 24, feeding heated primary air into the pulverizer 10. This creates a stream of air that carries the particles of pulverized coal upward from the grinding surface 14 where they enter classifier vanes 26 of a classifier 28 that establish a swirling flow within the classifier 28 and reject cone 30. The centrifugal force set up in the reject cone 28 prevents coarse pieces of coal from being discharged from the pulverizer 10. In particular, coarse pieces of coal fall by force of gravity back into the grinding surface 12, to be reground by the grinding rollers 22 until they reach a desired degree of fineness. The pulverized coal that is not too coarse, however, is directed by the swirling flow of air upwards through a deflector ring 34 of the classifier 28 and into one or more coal outlet pipes 36. The pulverized coal may then be carried by connected fuel conduits (not shown) to a furnace where it is burned as fuel.

While existing grinding rollers, and the configuration of the journal assemblies on which they are carried, are generally suitable for what is regarded as ordinary performance, there is room for improvement in terms of performance, reliability and safety. In particular, existing designs may suffer from reliability issues, such as journal bearing reliability issues, over extended periods of use, which require journal assembly servicing and/or replacement. In addition, existing solutions for increasing the capacity of the pulverizer in terms of coal throughput have heretofore relied on increasing the size of the grinding rollers of the pulverizer, which requires complete removal and replacement of existing machinery, which is particularly time consuming and expensive.

In view of the above, there is a need for a retrofit apparatus and related method for upgrading a pulverizer to increase capacity and safety while improving reliability that involve minimal changes to existing equipment.

BRIEF DESCRIPTION

In an embodiment, a method of upgrading a vertical spindle pulverizer is provided. The method includes the steps of removing a cover from a journal opening in a housing of the pulverizer to access a grinding zone of the pulverizer, removing a first journal assembly having a toroidal grinding roll from the pulverizer through the journal opening, removing a plurality of toroidal table segments from a grinding table of the pulverizer, installing a plurality of inclined bull ring segments on the grinding table, installing a second journal assembly having a conical grinding roll in the pulverizer, and replacing the cover over the journal opening. The inclined bull ring segments are configured to register with a grinding surface of the conical grinding roll.

In another embodiment, a method for increasing the capacity of a vertical spindle pulverizer is provided. The method includes the steps of removing a cover from a journal opening in the pulverizer to access a grinding zone of the pulverizer, removing a first journal assembly having a generally toroidal grinding roll from the pulverizer through the journal opening, removing a plurality of generally toroidal table segments from a grinding table of the pulverizer, installing a plurality of generally flat, inclined bull ring segments in the grinding table, installing a second journal assembly having a conical grinding roll in the pulverizer, and replacing the cover over the journal opening.

In yet another embodiment, a vertical spindle pulverizer is provided. The pulverizer includes a housing having a shaft coupled for rotation therein, a grinding table rotatably mounted on the shaft, the grinding table having a plurality of generally flat, inclined bull ring segments that have been retrofit onto the grinding table in place of table segments with a generally toroidal profile, a journal assembly pivotally mounted on the pulverizer housing, and a generally conical grinding roll coupled to the journal assembly, wherein the journal assembly and grinding roll are retrofit into the pulverizer in place of an existing journal assembly having a generally toroidal grinding roll.

DRAWINGS

The present invention will be better understood from reading the following description of non-limiting embodiments, with reference to the attached drawings, wherein below:

DETAILED DESCRIPTION

Figure 1:
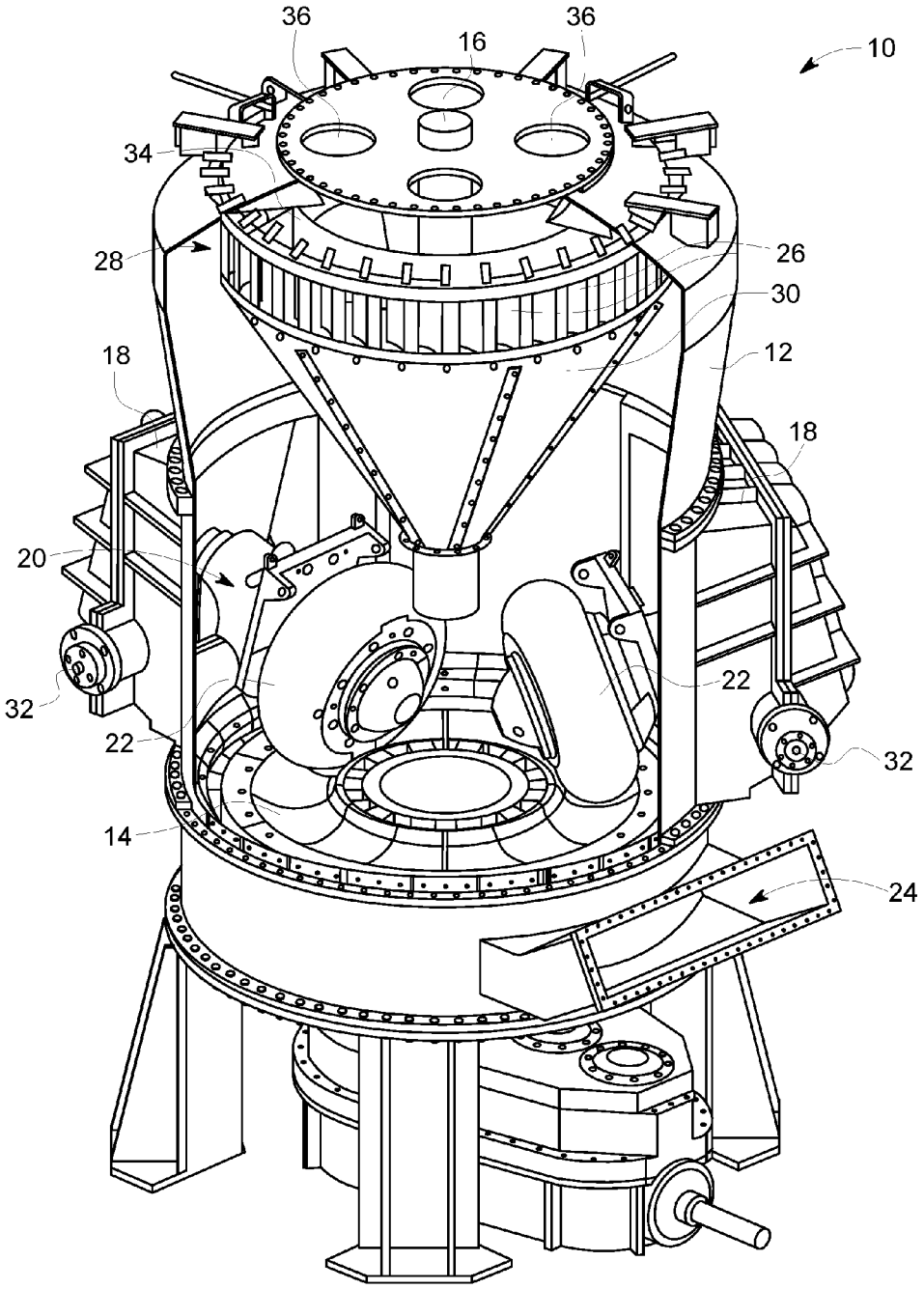
FIG. 1 PRIOR ART
FIG. 1 is a perspective view of a coal pulverizer or mill of the prior art.

Reference will be made below in detail to exemplary embodiments of the invention, examples of which are illustrated in the accompanying drawings. Wherever possible, the same reference characters used throughout the drawings refer to the same or like parts. While embodiments of the invention are directed to a system and method for upgrading the performance and capacity of a vertical spindle type pulverizer having a journal assembly with torus-shaped grinding rolls, and a torus-shaped grinding surface for registering with the torus-shaped grinding rolls, embodiments of the invention may also be applicable to pulverizers having grinding rolls and table segments of other shapes for which capacity improvements utilizing conical grinding rolls may be possible. In addition, embodiments of the invention may also be applicable for pulverizers of a type of than vertical-spindle type pulverizers.

As used herein, "operatively coupled" refers to a connection, which may be direct or indirect. The connection is not necessarily being a mechanical attachment. As used herein, "mechanically coupled" refers to any coupling method capable of supporting the necessary forces for transmitting torque between components. As used herein, "toroidal" means having a generally torus shape.

Figure 2:
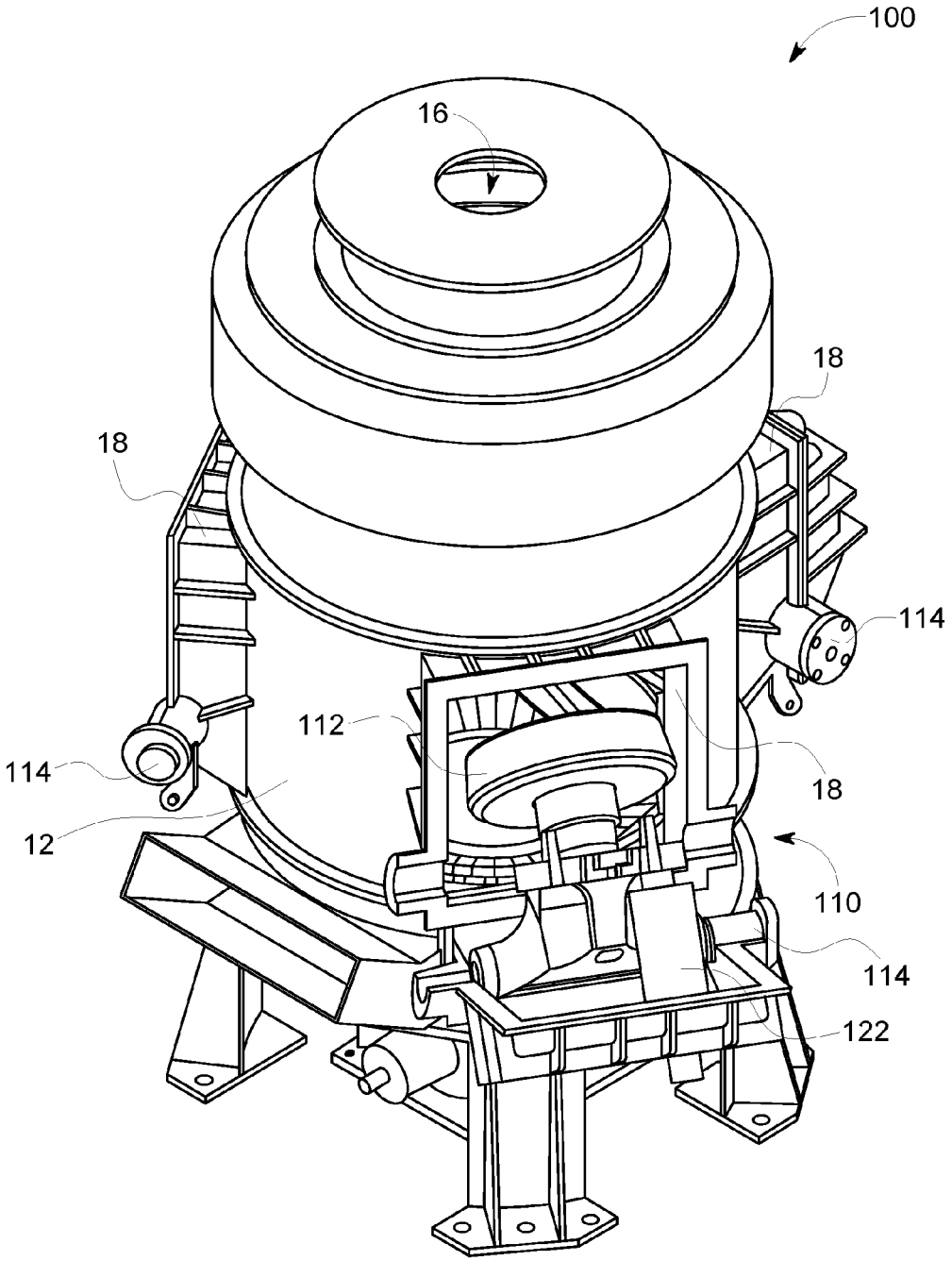
FIG. 2 is a perspective view of a coal pulverizer having an improved journal assembly and grinding roll, according to an embodiment of the invention.
Figure 3:
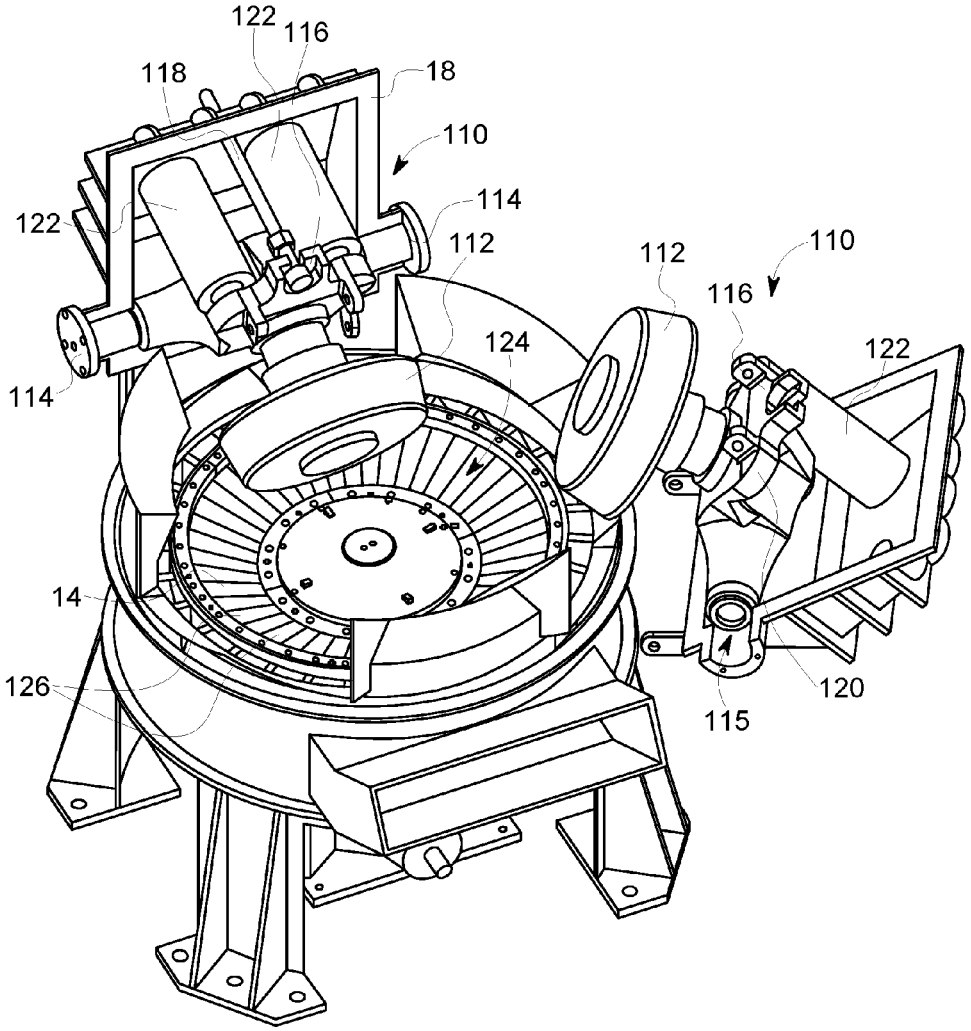
FIG. 3 is a perspective view of a portion of the coal pulverizer of FIG. 1, showing the improved journal assembly and grinding roll.

Embodiments of the invention relate to a journal assembly and grinding roll that is capable of being retrofit into existing pulverizers to increase pulverizer capacity (including coal throughput) as well as improve journal assembly reliability, and a related method for upgrading a pulverizer with such a journal assembly and grinding roll. With reference to FIGS. 2 and 3, a pulverizer 100 that has been upgraded with a journal assembly and grinding according to an embodiment of the invention is shown. The pulverizer 100 may generally take the form of any vertical-spindle, bowl mill type pulverizer known in the art, such as the pulverizer 10 described above in connection with FIG. 1, where like reference numerals designate like parts. For example, the pulverizer 100 may be a MPS, MB, MBF, VS, ZGM type pulverizer that includes a generally cylindrical housing 12 at the bottom of which is supported a rotating grinding table 14 defining a grinding surface, and which is fed with a supply of raw coal through a coal chute 16. The grinding table 14 may be mounted on a shaft (not shown) that in turn is operatively connected to a suitable gearbox drive mechanism (not shown) so as to be capable of being suitably driven for rotation within the pulverizer housing 12.

The housing 14 includes a plurality of rectangular windows or journal openings 18 formed therein, within which a journal assembly 110 and grinding roll 112 of the invention can be mounted for pivotal movement. In particular, each journal assembly 110 is pivotally mounted on opposed pivot shaft segments 114 that are received by a pivot bracket 115. The pivot shaft segments 114 are shorter than conventional pivot shafts, which typically run the length of the pivot bracket, and bolt to the pivot bracket 115 using hardware. The use of two, shorter pivot segments 114 that do not extend the length of the pivot bracket 115 allows for easier removal and disassembly such as for servicing or maintenance, as the respective segments 114 can simply be pulled out from the outside of the housing 12. In addition, the shorter pivot segments 114 are less costly to manufacture than conventional pivot shafts. Moreover, the bushing that connects the pivot shaft segments 114 is designed so that the bushing may be lubricated from outside of the pulverizer 100, further contributing to the ease with which the journal assembly 110 may be disassembled for maintenance or service, as well as improving the life and reliability of the journal assembly, as a whole.

As shown in FIG. 2, the pulverizer 100 includes three journal assemblies 110, although the invention is not limited in this regard, and in other embodiments the pulverizer 100 may include fewer or more than three journal assemblies which may be distributed evenly about the grinding surface of the grinding table 14. Each journal assembly 110 carries a grinding roll 112 rotatably mounted thereon and positions the grinding roll 112 to define a gap between the grinding roll 112 and the grinding surface of the grinding table 14. As is known in the art, the gap contributes to determining the particle size distribution of the pulverized material produced in the pulverizer. The gap varies when the journal assembly 110 pivots on the pivot shaft 114. The journal assembly 110 includes a journal stop flange 116 connected to one end of a stop bolt 118, which is secured at its opposing end to the pulverizer housing 12. The stop bolt 118 serves to limit the pivoting motion of the journal assembly toward the grinding surface 14, thus setting a minimum size for the gap between the grinding roll and grinding surface. In particular, the stop bolt 118 connects to the housing 12 of the pulverizer 100 and provides control of the clearance between the grinding roll 112 and the grinding table surface 14, eliminating deterioration of grinding elements due to impact. This is in contrast to existing pulverizers that utilize toroidal grinding rolls, which do not utilize any such stop bolt or functionally similar component (where the grinding roll typically rides directly on the grinding segments of the bowl).

Moreover, existing designs that do not utilize a stop bolt can exhibit grinding roll skidding depending on load and coal properties. Existing designs do not have any mechanism to prevent or remedy this issue. This can create safety issues and increases spillage as the coal bed on top of the bowl becomes unstable. The stop bolt 118 utilized by the journal assembly 110, however, provides precise control over the pivoting motion of the journal assembly 110 to remedy any grinding roll skidding, reduce spillage, eliminate safety risks, as well as allows performance to be controlled for varying coal properties to provide maximum capacity.

With further reference to FIGS. 2 and 3, each journal assembly 110 also includes a journal head 120 upon which a biasing force is exerted by one or more spring assemblies 122 connected to the housing 12. In particular, the spring assemblies 122 establish a mechanical spring loading on the corresponding grinding rolls 112 to exert the requisite degree of force on the sold fuel disposed on the grinding table 14 to pulverize the fuel. In certain embodiments, hydraulic cylinders are used in place of springs to complete the same task while providing control of force.

Figure 4:
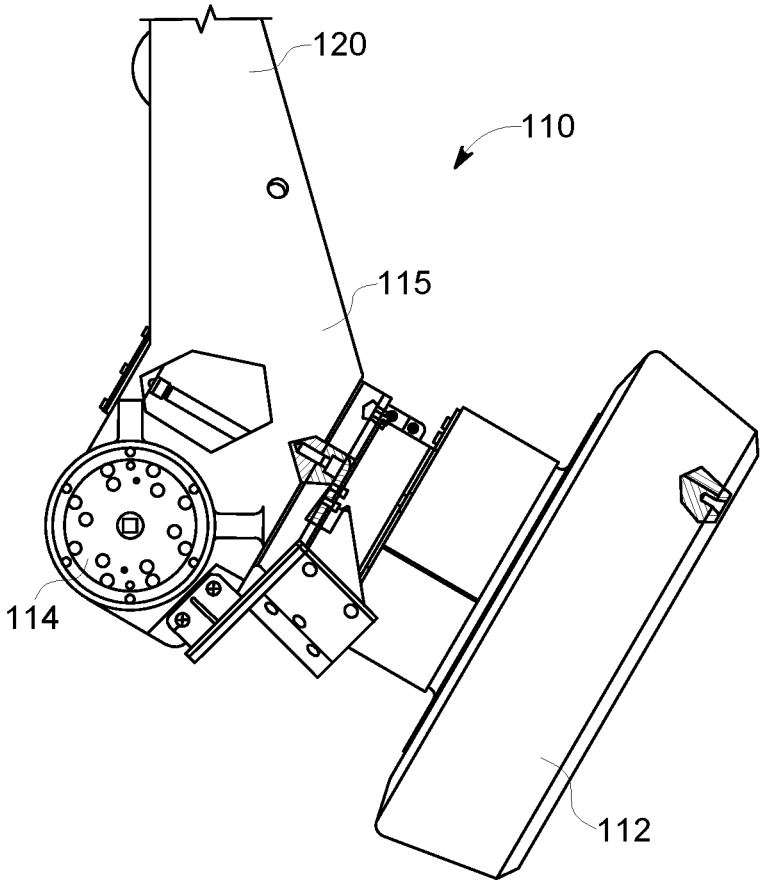
FIG. 4 is a side elevational view of the improved journal assembly and grinding roll, according to an embodiment of the invention.
Figure 5:
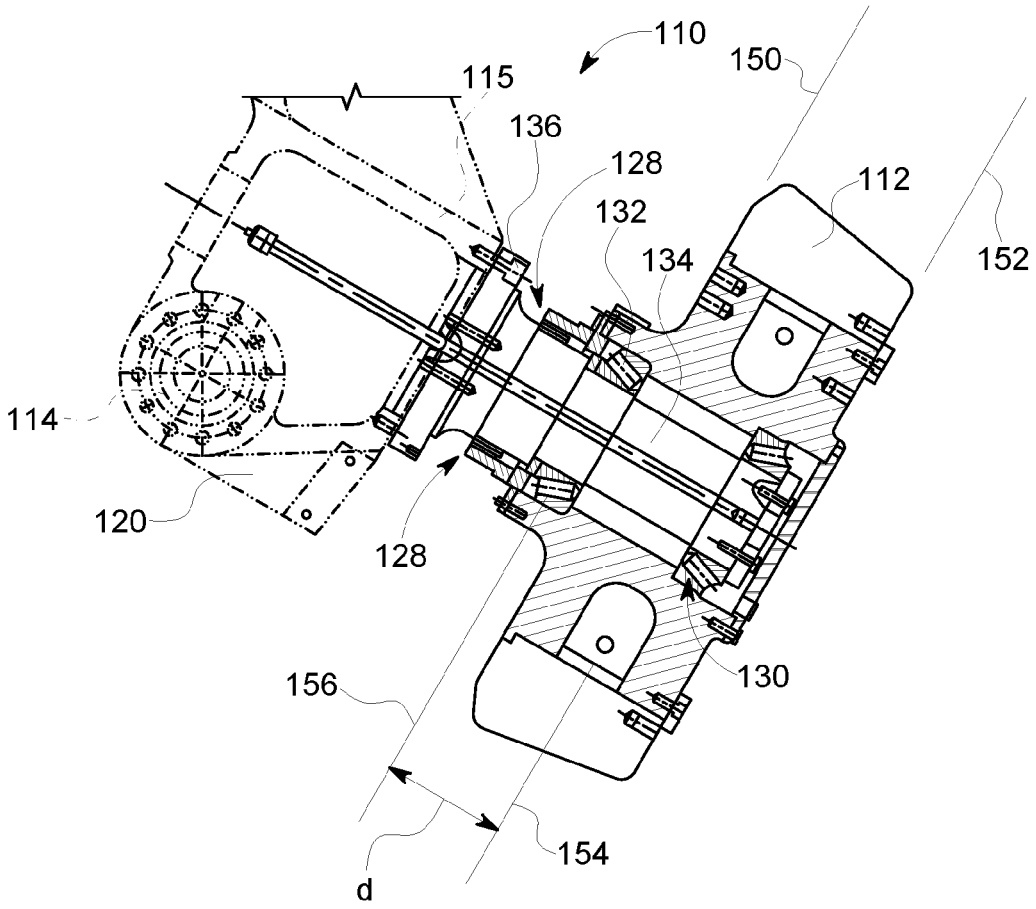
FIG. 5 is a side, cross-sectional illustration of the journal assembly and grinding roll of FIG. 4.

Turning now to FIGS. 4 and 5, the journal assembly 110 and grinding roll 112 is more clearly illustrated. As shown therein, the grinding roll 112 is conical in shape, in contrast to the toroidal rolls typically utilized in existing pulverizers. In addition to retrofitting the pulverizer 100 with the journal assembly 110 and conical grinding roll 112, as discussed hereinafter, the grinding table 14 may be replaced or retrofit with a bull ring 124 having a plurality of substantially flat, inclined grinding segments 126 that correspond to the inclined, flat sides of the conical grinding roll 112. The use of a conical grinding roll 112 and corresponding flat bull ring segments 126 instead of a toroidal roll (and toroidal shaped bowl) provides a mechanical advantage by increasing the percentage of attrition grinding and the active area of the bowl for increase efficiency.

In connection with the above, the journal assembly 110 and grinding roll 112 have a steeper grinding angle than conventional, toroidal grinding rolls, which increases the attrition grinding and shear between the particles between the grinding elements. This further increases the percentage of attrition grinding. In an embodiment, the grinding angle (which is defined by the angle of the journal shaft of the journal assembly from the horizontal plane) is between approximately 25 to 35 degrees. This is in contrast to the much shallower angle of existing journal assemblies, which is typically on the order of about 12 to about 18 degrees.

As also shown in FIGS. 4 and 5, the journal assembly 110 utilizes three oil seals 128 instead of the two typically utilized on existing journal assemblies, and the seals are located further away from the grinding roll 112 than is conventional, which has been found to reduce the likelihood of any particles compromising such seals 128. In this position, the seals 128 can be replaced without having to remove the journal shaft 114 from the pivot bracket 115, making servicing much more convenient and streamlined.

The journal assembly 110 also features an improved bearing arrangement that has been discovered to lengthen the life of the bearings. In particular, existing journal assembly designs use a cylindrical and spherical roller bearing which, due to the arrangement of such bearings with respect to the location of the loads, have a limited life. With existing bearing arrangements, the bearings must carry both an axial and radial thrust load, with the spherical bearing carrying the entire thrust load. This often leads to the spherical roller bearing failing first. The journal assembly 110 of the invention, however, utilizes two tapered roller bearings 130, 132 which are located so as to provide a more optimal arrangement with respect to the location of the loads. These roller bearings 130, 132 carry both the thrust loads, as well as the radial loads. In particular, as best shown in FIG. 5, the bearings 130, 132 are spaced further apart than in conventional journal assemblies with toroidal grinding rolls, and the rear bearing (or upper bearing 132) is spaced further away from the centerline of the roll, further decreasing the thrust load on the bearings. As illustrated therein, the rear bearing 132 is spaced outside of the surface planes 150, 152 defined by the roller surfaces and, specifically, rearward of the rear surface plane 150. As a result of this arrangement, the bearings 130, 132 have a higher load-carrying capability and greater life as compared to existing arrangements.

In addition to the above, the journal assembly 110, when installed in existing vertical spindle type pulverizers has a lower ratio of bowl diameter (the diameter as measured across the grinding table 14) to distance, d, from a center plane 154 of the grinding roll to the center plane 156 of the outboard bearing 132. In an embodiment, the ratio of bowl diameter to the distance, d, from the center plane 154 of the grinding roll 112 to the center plane 156 of outboard bearing 132 is from about 5 to about 11. This is in contrast to a ratio in the range from about 12 to about 22 for conventional pulverizers with torus-shaped grinding rolls.

As further shown in FIGS. 4 and 5, the journal assembly 110 includes a journal shaft 134 that is received by the upper and lower bearings 130, 132. A close cylindrical fit is utilized to center the journal shaft 134 on the pivot bracket. The journal shaft 134 may then be simply bolted to the pivot bracket 115 using standard hardware, such as bolts 136. This is in contrast to existing configurations, which utilizes a self-locking taper fit or keyed fit between the journal shaft and pivot bracket with a large, custom nut to hold the components in registration with one another. When maintenance is performed on such existing journal assemblies, however, it is challenging to loosen the nut without damaging the threads, and it can be difficult to break the tapered connection. The bolted connection of the journal assembly 110, however, makes it much easier to disassemble the journal shaft 134 from the pivot bracket 115 for maintenance or the like.

Figure 6:
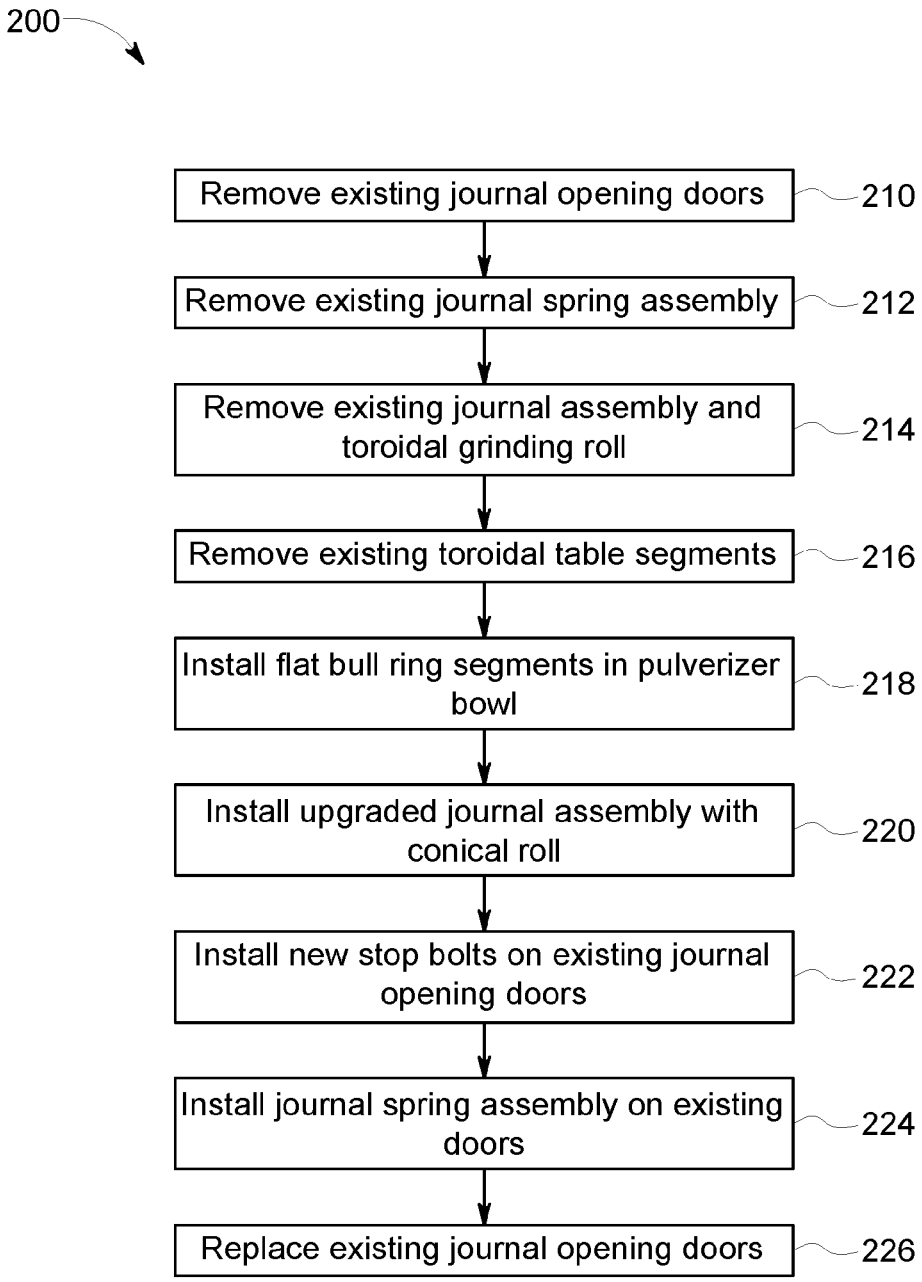
FIG. 6 is a diagram illustrating a method for upgrading a pulverizer, according to an embodiment of the invention.

Referring now to FIG. 6, a method 200 for upgrading a pulverizer and, specifically, a vertical spindle type pulverizer that has a toroidal grinding roll and corresponding toroidal table segments, is shown. First, at step 210, the covers or doors covering the journal openings of the pulverizer to be upgraded are removed. The journal spring assemblies are then removed to permit access to the journal assembly and grinding roll, at step 212. After the spring assemblies are removed, the existing journal assembly and toroidal grinding rolls are then removed from the pulverizer, at step 214. In order to establish a mating interface between the new grinding rolls to be installed and the grinding surface, the existing toroidal table segments of the grinding table are also removed, at step 216. Once the existing journal assembly, toroidal grinding roll and corresponding toroidal table segments are removed, the improved journal assembly 110 and conical grinding roll 112 can be retrofit into the pulverizer. This retrofit process includes, at step 218, installing flat bull ring segments 126 corresponding to a conical grinding roll 112 in the bowl of the pulverizer. At step 220, the journal assembly 110 with the conical grinding roll 112 is then installed. Once the journal assembly 110 is in place, new stop bolts 118 can be installed on the existing pulverizer doors, at step 222. Next, the existing, old journal spring assemblies 122 can be installed on the existing journal opening doors, at step 224. Finally, at step 226, the existing journal opening doors can be replaced to cover the journal openings.

In contrast to the upgrade method disclosed herein, existing solutions for improving performance and throughput of vertical spindle type pulverizers having toroidal grinding rolls and corresponding table segments have involved upgrading the classifier and airport (also referred to as a rotating throat or vane wheel) of the pulverizer. None of the existing solutions for improving performance, however, have involved any conversions or modifications to the grinding zone of the pulverizer. The system and method of upgrading the grinding zone of an existing pulverizer, as discussed above, can be implemented in less time than existing classifier and/or vane wheel upgrades and yield similar, if not greater, capacity and throughout improvements. In particular, the grinding zone upgrade method of the invention can result in an estimated 20% to about 40% capacity improvement, whereas upgrading the classifier and vane wheel have shown to only yield a 5% to 20% improvement in a pulverizer's capacity. Moreover, the cost per percent capacity improvement utilizing the grinding zone retrofit/upgrade method of the invention is significantly less than that upgrades to other pulverizer components. In addition to capacity and throughput improvements, the reliability of the journal assembly, grinding roll and pulverizer, as a whole, may be significantly improved by upgrading the journal assembly and grinding roll in the manner discussed herein.

It is further contemplated that the rotation speed of the grinding table 14 may also be adjusted to maximize capacity for the new grinding element geometry. In particular, once the toroidal grinding rolls and existing journal assemblies have been replaced with the journal assembly 110 and conical grinding roll described herein, the rotation speed of the grinding surface/table 14 may also be adjusted in dependence on the new grinding roll geometry in order to maximize performance and throughput. This process may involve determining the optimum particle tangential velocity across the grinding table 14 that achieves increased capacity while ensuring that the particular bed does not become too sparse, which can result in vibration of the grinding elements.

In an embodiment, a method of upgrading a vertical spindle pulverizer is provided. The method includes the steps of removing a cover from a journal opening in a housing of the pulverizer to access a grinding zone of the pulverizer, removing a first journal assembly having a toroidal grinding roll from the pulverizer through the journal opening, removing a plurality of toroidal table segments from a grinding table of the pulverizer, installing a plurality of inclined bull ring segments on the grinding table, installing a second journal assembly having a conical grinding roll in the pulverizer, and replacing the cover over the journal opening. The inclined bull ring segments are configured to register with a grinding surface of the conical grinding roll. In an embodiment, the method may also include installing a stop bolt on the cover prior to replacing the cover, wherein the stop bolt is configured to determine a spacing between the conical grinding roll and the flat bull ring segments of the grinding table. In an embodiment, the method may further include the step of removing a journal spring assembly of the pulverizer prior to removing the first journal assembly. In an embodiment, the method may also include the step of, installing the journal spring assembly on the cover after installing the stop bolt and prior to replacing the cover. In an embodiment, the journal assembly includes a bolted connection between a journal shaft and pivot bracket of the journal assembly. In an embodiment, the step of installing the second journal assembly in the pulverizer includes mounting the second journal assembly to a pivot bracket on which the journal assembly is configured to pivot via two opposed pivot shaft segments. In an embodiment, the opposed pivot shaft segments mounted to the mill body housing are spaced from one another and do not extend a length of the pivot bracket. In an embodiment, the method may also include the step of adjusting the rotational speed of the grinding table in dependence upon the geometry of the conical grinding roll.

In another embodiment, a method for increasing the capacity of a vertical spindle pulverizer is provided. The method includes the steps of removing a cover from a journal opening in the pulverizer to access a grinding zone of the pulverizer, removing a first journal assembly having a generally toroidal grinding roll from the pulverizer through the journal opening, removing a plurality of generally toroidal table segments from a grinding table of the pulverizer, installing a plurality of generally flat bull ring segments in the grinding table, installing a second journal assembly having a conical grinding roll in the pulverizer, and replacing the cover over the journal opening. In an embodiment, the step of installing the second journal assembly having the conical grinding roll includes inserting the second journal assembly having the conical grinding roll through the journal opening, arranging the second journal assembly having the conical grinding roll in the grinding zone of the pulverizer, and mounting the second journal assembly to a pivot bracket on which the journal assembly is configured to pivot via two opposed pivot shaft segments. In an embodiment, the opposed pivot shaft segments are spaced from one another and do not extend a length of the pivot bracket. In an embodiment, the flat bull ring segments are configured to register with a grinding surface of the conical grinding roll. In an embodiment, the method may also include the step of installing a stop bolt on the cover prior to replacing the cover, wherein the stop bolt is configured to determine a spacing between the conical grinding roll and the flat bull ring segments of the grinding table. In an embodiment, the method may also include the steps of removing a journal spring assembly of the pulverizer prior to removing the first journal assembly and installing the journal spring assembly on the cover after installing the stop bolt and prior to replacing the cover. In an embodiment, the second journal assembly includes a bolted connection between a journal shaft and the pivot bracket.

In yet another embodiment, a vertical spindle pulverizer is provided. The pulverizer includes a housing having a shaft coupled for rotation therein, a grinding table rotatably mounted on the shaft, the grinding table having a plurality of generally flat bull ring segments that have been retrofit onto the grinding table in place of generally toroidal table segments, a journal assembly pivotally mounted on the pulverizer housing, and a generally conical grinding roll coupled to the journal assembly, wherein the journal assembly and grinding roll are retrofit into the pulverizer in place of an existing journal assembly having a generally toroidal grinding roll. In an embodiment, the journal assembly is pivotally mounted on the pulverizer housing via two opposed pivot shaft segments that do not extend a length of a pivot bracket and are accessible from outside of the housing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method for increasing the capacity of a vertical spindle pulverizer, comprising the steps of:

removing a cover from a journal opening in the pulverizer to access a grinding zone of the pulverizer;

removing a first journal assembly having a toroidal grinding roll from the pulverizer through the journal opening;

removing a plurality of toroidal table segments from a grinding table of the pulverizer;

installing a plurality of inclined bull ring segments on the grinding table;

installing a second journal assembly having a conical grinding roll in the pulverizer; and replacing the cover over the journal opening.

2. The method according to claim 1, wherein:

the step of installing the second journal assembly having the conical grinding roll includes:

inserting the second journal assembly having the conical grinding roll through the journal opening;

arranging the second journal assembly having the conical grinding roll in the grinding zone of the pulverizer; and mounting the second journal assembly to a pivot bracket on which the journal assembly is configured to pivot via two opposed pivot shaft segments.

3. The method according to claim 2, wherein: the opposed pivot shaft segments are spaced from one another and do not extend a length of the pivot bracket.

4. The method according to claim 3, further comprising the step of:

installing a stop bolt on the cover prior to replacing the cover;

wherein the stop bolt is configured to determine a spacing between the conical grinding roll and flat bull ring segments of the grinding table.

5. The method according to claim 4, further comprising the steps of:

removing a journal spring assembly of the pulverizer prior to removing the first journal assembly; and installing the journal spring assembly on the cover after installing the stop bolt and prior to replacing the cover.

6. The method according to claim 5, wherein: the second journal assembly includes a bolted connection between a journal shaft and the pivot bracket.

7. The method according to claim 2, wherein: flat bull ring segments are configured to register with a grinding surface of the conical grinding roll.

8. A method of upgrading a vertical spindle pulverizer, comprising the steps of:

removing a cover from a journal opening in a housing of the pulverizer to access a grinding zone of the pulverizer;

removing a first journal assembly having a toroidal grinding roll from the pulverizer through the journal opening;

removing a plurality of toroidal table segments from a grinding table of the pulverizer; installing a plurality of inclined bull ring segments on the grinding table; installing a second journal assembly having a conical grinding roll in the pulverizer; and replacing the cover over the journal opening; wherein the inclined bull ring segments are configured to register with a grinding surface of the conical grinding roll.

9. The method according to claim 8, further comprising the step of:

installing a stop bolt on the cover prior to replacing the cover;

wherein the stop bolt is configured to determine a spacing between the conical grinding roll and the inclined bull ring segments of the grinding table.

10. The method according to claim 9, further comprising the step of:

removing a journal spring assembly of the pulverizer prior to removing the first journal assembly.

11. The method according to claim 10, further comprising the step of:

installing the journal spring assembly on the cover after installing the stop bolt and prior to replacing the cover.

12. The method according to claim 8, wherein: the step of installing the second journal assembly in the pulverizer includes mounting the second journal assembly to a pivot bracket on which the journal assembly is configured to pivot via two opposed pivot shaft segments.

13. The method according to claim 12, wherein: the opposed pivot shaft segments are spaced from one another and do not extend a length of the pivot bracket.

14. The method according to claim 8, wherein: the second journal assembly includes a bolted connection between a journal shaft and pivot bracket of the journal assembly.

15. The method according to claim 8, further comprising the step of: adjusting a rotational speed of the grinding table in dependence upon the geometry of the conical grinding roll.

* * * * *